United States Patent [19]

Rohr

[11] 4,052,299

[45] Oct. 4, 1977

[54] APPARATUS FOR WASHING IMPURITIES OUT OF GRANULAR MATERIAL

[76] Inventor: Wolfgang Rohr, Altriper Str. 115, Waldsee, Germany, D-6701

[21] Appl. No.: 644,637

[22] Filed: Dec. 29, 1975

[30] Foreign Application Priority Data

Sept. 26, 1975 Germany ..... 2542940

[51] Int. Cl.[2] ..... B03B 5/08

[52] U.S. Cl. ..... 209/430; 209/155

[58] Field of Search ..... 209/18, 155, 428–433; 198/204

[56] References Cited

U.S. PATENT DOCUMENTS

| | | | |
|---|---|---|---|
| 544,880 | 8/1895 | Bouk et al. | 209/430 |
| 1,316,038 | 9/1919 | Jackson | 209/429 |
| 2,417,477 | 3/1947 | Finney | 209/428 |
| 3,265,192 | 8/1966 | Stadelman | 198/204 |

FOREIGN PATENT DOCUMENTS

| | | | |
|---|---|---|---|
| 649,499 | 12/1928 | France | 209/18 |
| 2,263,549 | 7/1974 | Germany | 209/429 |

*Primary Examiner*—Frank W. Lutter
*Assistant Examiner*—Ralph J. Hill
*Attorney, Agent, or Firm*—Kurt Kelman

[57] ABSTRACT

Freshly dredged gravel is washed free of loamy and organic impurities while being continuously conveyed through a wash zone which includes a delivery chute and a plane endless conveyor band entrained in a direction opposite to that of the material delivery. The conveyor band is mounted in a housing which includes side walls closely adjacent the lateral edges of the conveyor band and a hopper below the conveyor band. The conveyor band is trained over a vertically adjustably mounted drive roller and a tensioning roller defining an upper and a lower course of the conveyor band therebetween. Two additional rollers are arranged in vertical alignment and between the first-named rollers, a lower one of these rollers guiding the lower conveyor band course and an upper one of these rollers being vertically adjustably mounted and arranged to depress the upper conveyor band course to form a basin in the wash zone to which the chute delivers the granular material.

3 Claims, 5 Drawing Figures

APPARATUS FOR WASHING IMPURITIES OUT OF GRANULAR MATERIAL

The present invention relates to improvements in an apparatus for washing out organic and loamy impurities from a solid granular material, such as freshly dredged and prepared gravel, continuously conveyed through a wash zone.

German Auslegeschrift (accepted and published patent application) No. 2,263,549, published July 11, 1974, discloses an apparatus of this general type which comprises liquid spray means arranged in the wash zone for spraying wash liquid, such as water, on the material and forming a mixture of the wash liquid and the material as a chute in the wash zone continuously delivers the solid granular material in a first direction. An endless conveyor band trained over a set of rollers is entrained in a direction opposite to the first direction by one of the rollers. The upper course of the conveyor band is divided into an ascending downstream portion extending underneath the chute and an upstream portion, and the two conveyor band portions define a wash basin for the material, the washed granular material being conveyed by the ascending downstream portion while the sludge formed by the wash water and impurities flows over the upstream portion and into a container receiving the overflowing sludge by gravity.

The two portions of the conveyor band are fixed to two frame parts which are pivotal about a common bearing and the conveyor band has two laterally extending upright rims to hold the material and sludge on the conveyor band. The special type of conveyor band required and the pivotal mounting of the two conveyor portions make the apparatus complex and expensive. The special conveyor band requires guide and support rollers of relatively large minimum diameters and the capacity of the apparatus is limited since only a certain thickness of material can be carried on the conveyor band. Also, the nature of the conveyor band is such that some impurities will be conveyed by the downstream portion, together with the granular material.

It is the primary object of this invention to improve the above-described apparatus by making its structure simpler while increasing its capacity for cleaning freshly dredged gravel.

This and other objects are accomplished in accordance with the invention in an apparatus of the indicated type by the use of a plane endless conveyor band and a set of rollers which includes a first pair of the rollers cooperating to define the upper and lower course of the conveyor band therebetween, and a second pair of the rollers arranged in vertical alignment on a vertical support and between the rollers of the first pair, a lower one of the rollers of the second pair guiding the lower course of the conveyor band and an upper one of the rollers of the second pair being vertically adjustably mounted on the vertical support. The upper roller is arranged to depress the upper course of the conveyor band and to form a basin in the wash zone and the chute is arranged to deliver the solid granular material continuously to the basin. The upper rollers consists of a series of spaced apart disc-like elements and divides the upper course of the conveyor band into an ascending downstream portion extending underneath the chute and an upstream portion, and one of the rollers of the first pair guides the ascending downstream portion of the conveyor band underneath the chute and is vertically adjustably mounted. The conveyor band is mounted in a housing which includes side walls closely adjacent the lateral edges of the plane conveyor band and a hopper below the conveyor band.

The above and other objects, advantages and features of the present invention will become more apparent from the following detailed description of a now preferred embodiment thereof, taken in conjunction with the accompanying drawing wherein FIG. 1 shows a side elevational view of the apparatus;

Figure 1:
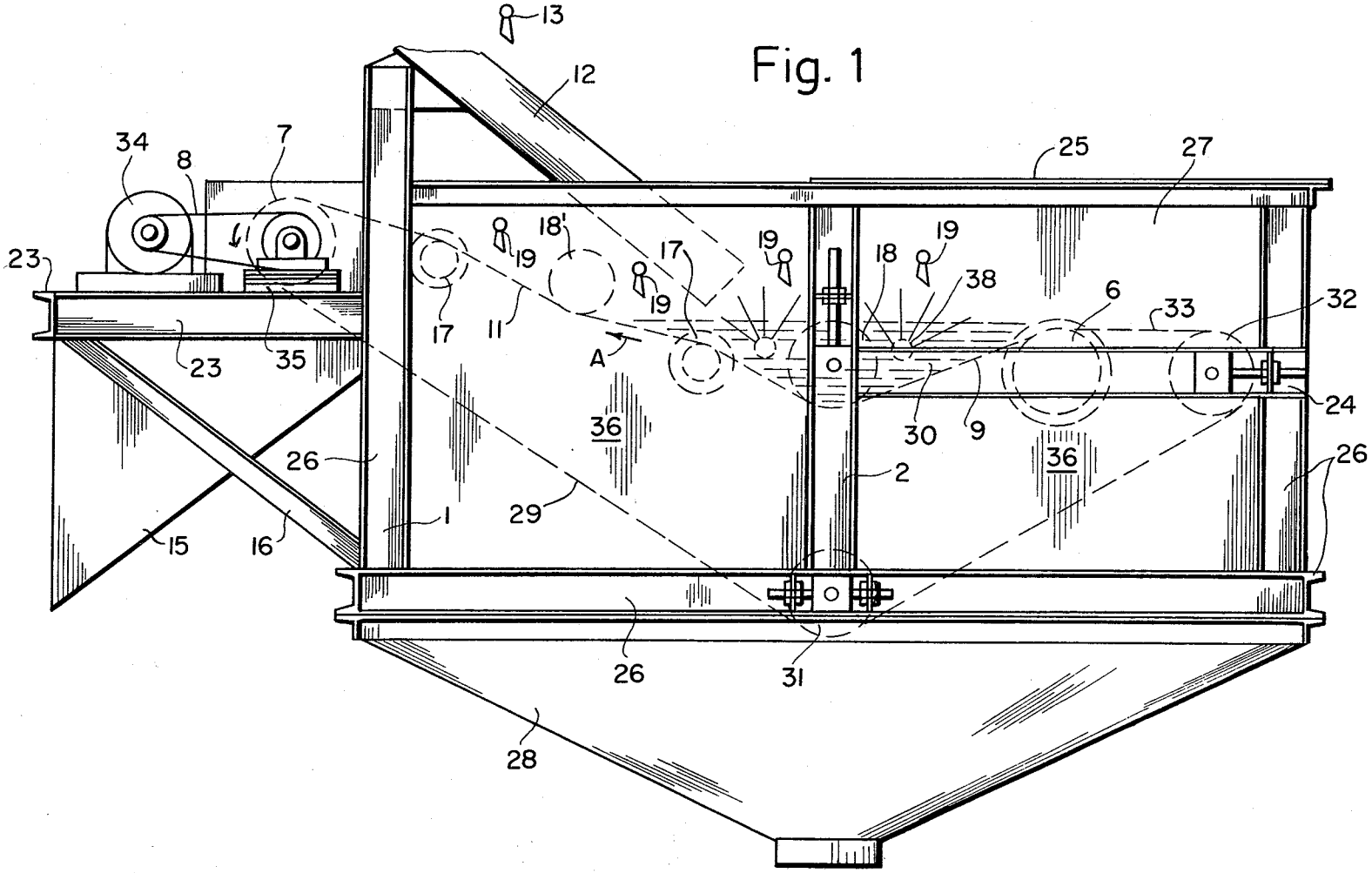

Referring now to the drawing, there is shown frame 1 consisting of horizontal and vertical supports or trusses 26 holding side walls 36, 36 defining housing 27 and hopper 28 at the bottom of the housing. Intermediate corner posts 26 of the housing, there are mounted vertical supports 2, 2 and half of the top of housing 27 is covered by top wall 25, leaving the other half of the housing top open to enable chute 12 to descend into the housing. Chute 12 is mounted on frame 1 in any suitable manner and is preferably pivotal to adjust its angle of delivery.

Solid granular material, such as freshly dredged and prepared gravel containing organic and loamy impurities, is continuously delivered in a first direction on chute 12 to plane endless conveyor band 29 entrained by drive roller 7 in a direction opposite to the first direction, the chute and moving conveyor band continuously conveying the material through a wash zone wherein a series of suitably arranged spray nozzles 13 and 19 spray a wash liquid, such as water, on the material and form a mixture of the wash liquid and the material.

The endless conveyor band is trained over a set of rollers, including a first pair of rollers 7 and 32 which cooperate to define an upper and a lower course of the conveyor band therebetween. In the illustrated embodiment, one of these rollers is drive roller 7 which guides an ascending downstream portion 11 of conveyor band 29 underneath chute 12 and the other roller 32 is a conveyor band tensioning roller which is mounted in bearings on crossbeams 24. The roller bearings are adjustably mounted on the crossbeams to permit roller 32 to be moved for adjusting the tension of the conveyor band, as can be seen from FIG. 1.

Figure 2:
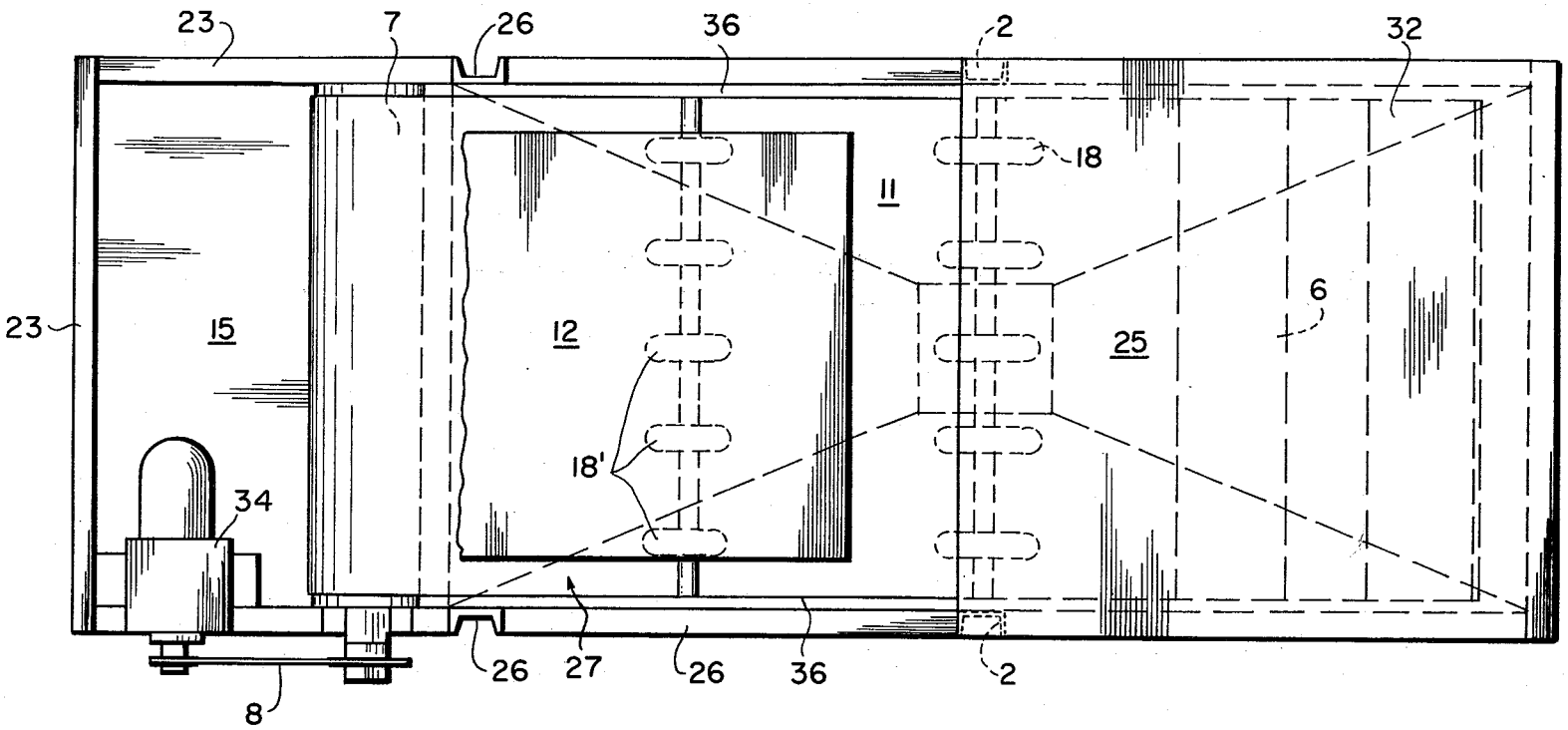
FIG. 2 is a top view of FIG. 1.
Figure 3:
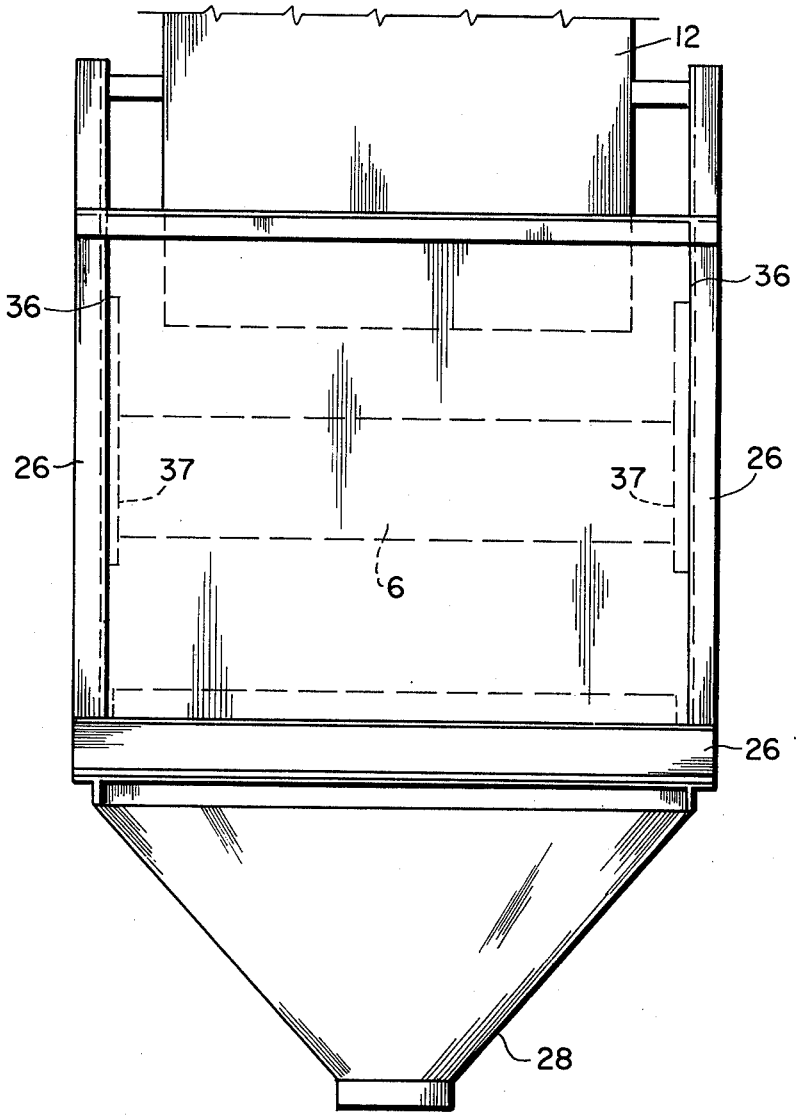
FIG. 3 is an end view of FIG. 1.
Figure 5:
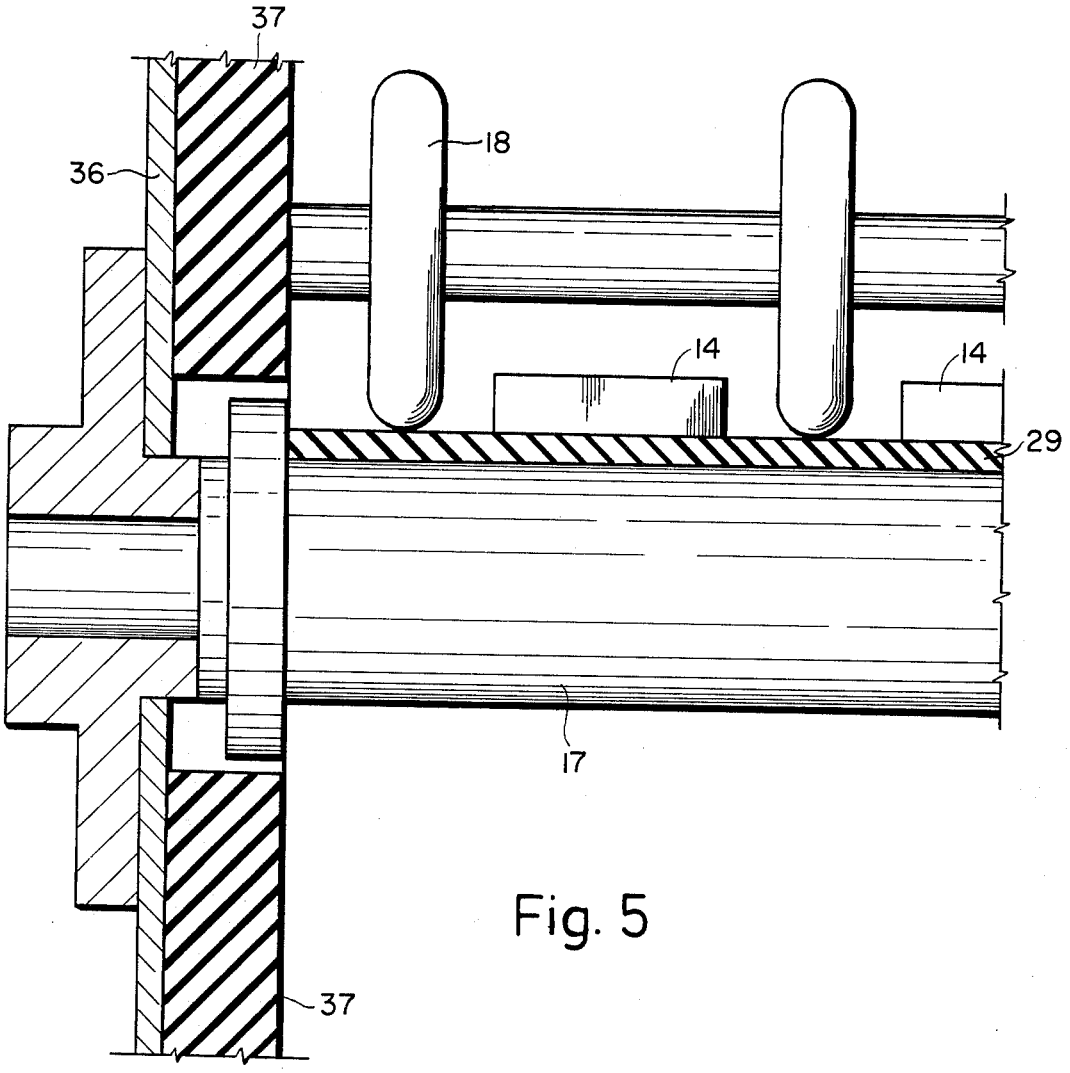
FIG. 5 is a partial section of the apparatus along line A—A of FIG. 4.

A second pair of rollers 18 and 31 is arranged in vertical alignment and between rollers 7 and 32, the rollers of the second pair being mounted in bearings on vertical supports 2, 2. Lower guide roller 31 guides the lower course of conveyor band 29 and upper roller 18 is vertically adjustably mounted on supports 2. The upper roller is arranged to depress the upper course of the conveyor band and to form basin 30 in the wash zone. Chute 12 is arranged to smart deliver the solid granular material continuously to the basin where a mixture of the material and wash liquid sprayed onto the material by spray nozzles 13 and 19 accumulates. As can be seen from FIGS. 2 and 5, upper pressure roller 18 consists of a series of spaced apart disc-like elements which permits the passage of material along the conveyor band past the pressure roller. The pressure roller divides the upper course of conveyor band 29 into ascending downstream conveyor band portion 11 extending underneath chute 12 to drive roller 7 and an upstream portion extending to tensioning roller 32.

The solid granular material forms a sediment in the basin, since it is the heavier portion of the mixture, and is conveyed in the direction of arrow A towards roller 7 by ascending downstream portion 11 of the conveyor band while the organic and loamy impurities form a sludge with the wash liquid, which sludge flows out of basin 30 and over the upstream portion of the conveyor band towards tensioning roller 32. A passageway in housing 27 adjacent roller 32 permits overflowing sludge to pass into hopper 28 by gravity for removal from the apparatus.

Figure 4:
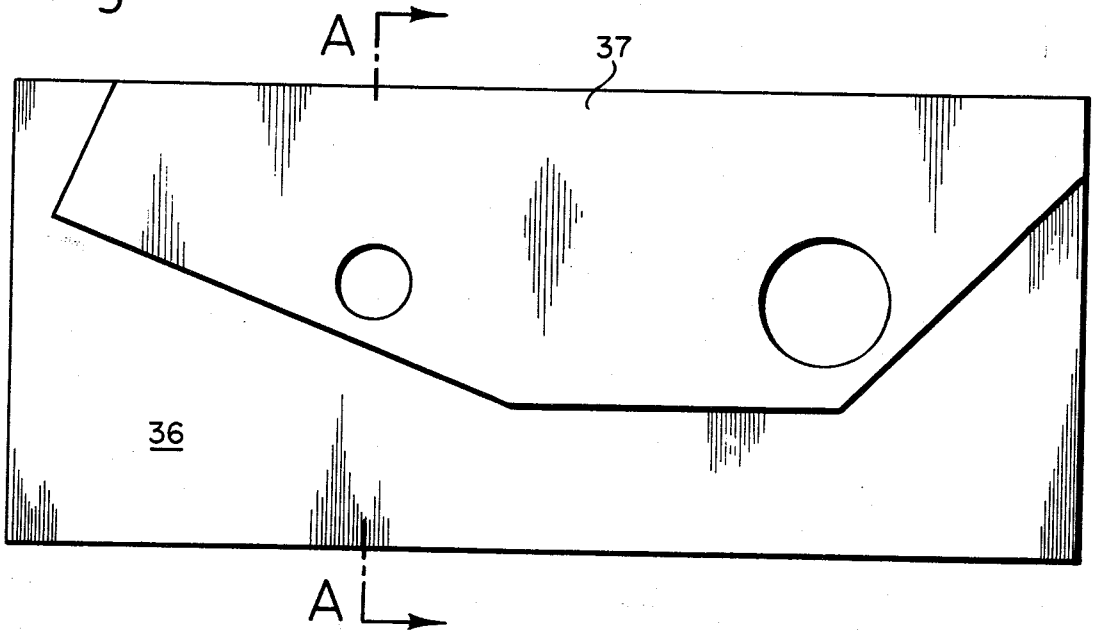
FIG. 4 is a side elevational view of a side wall of the apparatus housing, showing its rubber lining.

Side walls 36, 36 of housing 27 are closely adjacent the lateral edges of the conveyor band and to assure a more or less liquid-tight engagement between the conveyor band and the housing side walls, rubber lining 37 is mounted on the side walls in the range of the upper course of the conveyor band (see FIG. 4). This lining will also reduce wear of the lateral conveyor band edges and increase the life of the conveyor band in operation.

In the preferred embodiment herein illustrated, guide and support roller 6 divides the upstream portion of the conveyor band into ascending part 9 forming part of basin 30 and substantially horizontal part 33 between tensioning roller 32 and guide and support roller 6. This has the advantage of providing a quiet zone which facilitates the separation of the heavy sediment from the sludge and thus aids in the effective cleaning of the material. This effect is further increased by mounting upwardly directed nozzles 38 in basin 30 arranged to loosen the impurities from the granular material and to move the sludge upwardly so that it may flow over the upstream portion of the conveyor band. Movement of the washed granular material in the downstream direction will be enhanced by providing entrainment blocks or lugs 14 (see FIG. 5) on the conveyor band.

The downstream portion 11 of the conveyor band is slightly wave-shaped, this portion being guided and supported by a pair of rollers 17, 17 which press the conveyor band slightly upwardly while an intermediate pressure roller 18' slightly depresses the part of the conveyor band between support rollers 17, 17, as shown in FIG. 1. Additional spray nozzles 19 over this portion of the conveyor band will further wash any adhering impurities from the granular material and these liquid-suspended impurities will flow into basin 30.

Drive roller 7 is vertically adjustably mounted on a support structure outside housing 27. This support structure comprises horizontal supports or trusses 23 braced on frame 1 by support brackets 16 and the roller bearings are mounted on support plates 35, removal or addition of support plates adjusting the position of the drive roller vertically. Drive motor 34 is also mounted on support 23 and is connected to drive roller 7 by drive belt 8 to entrain the conveyor band. Discharge chute 15 for the cleaned granular material is arranged underneath roller 7 to receive the material by gravity and thus to recover the clean material from the apparatus.

Changing the angle of delivery chute 12, changing the angle of downstream portion 11 of the conveyor band and/or part 9 of the upstream conveyor band portion by vertical adjustment of roller 7 and/or roller 18, changing the spray angle and/or amount and/or pressure of sprayed wash liquid, and changing the speed of the conveyor band enables the apparatus to be adjusted to all types of solid granular materials and amounts and types of dirt admixed therewith to provide optimum wash conditions.

The apparatus hereinabove described and herein illustrated has the added advantage that it can be operated with an ordinary plane rubber conveyor band, for instance, the drive and other rollers over which the conveyor band is trained being of relatively small dimensions. The operating width and capacity may be increased by about 20%. The lateral seal between the conveyor band and the side walls of the housing makes it possible to pile up the conveyed material higher than heretofore, which increases the capacity of the apparatus. The operating life of the apparatus is long and its adaptability to various materials of different grain sizes and containing different types and amounts of impurities is high.

I claim:

1. An apparatus for washing out organic and loamy impurities from a solid granular material continuously conveyed through a wash zone, the granular material being heavier than the impurities, comprising the combination of a. liquid spray means arranged in the wash zone for spraying wash liquid on the material and forming a mixture of the wash liquid and the material, b. a chute in the wash zone for continuously delivering the solid granular material in a first direction, c. a plane endless conveyor band entrained in a direction opposite to the first direction, the conveyor band having two lateral edges, d. a set of rollers over which the endless conveyor band is trained, the set of rollers including 1. a first pair of rollers cooperating to define an upper and a lower course of the conveyor band, at least one of the rollers of the first pair being a drive roller for entraining the conveyor band in the opposite direction, 2. a second pair of rollers arranged in vertical alignment and between the rollers of the first pair, a lower one of the rollers of the second pair guiding the lower course of the conveyor band and an upper one of the rollers of the second pair being vertically adjustably mounted, the upper roller being arranged to depress the upper course of the conveyor band and to form a basin in the wash zone, the chute being arranged to deliver the solid granular material continuously to the basin, the upper roller consisting of a series of spaced apart disc-like elements and dividing the upper course of the conveyor band into an ascending downstream portion extending underneath the chute and an upstream portion, one roller of the first pair guiding the ascending portion of the conveyor band underneath the chute being vertically adjustably mounted, the heavier solid granular material forming a sediment in the basin and the ascending downstream portion of the conveyor band conveying the sediment towards the one roller of the first pair, and the lighter organic and loamy impurities forming a sludge with the wash liquid, the sludge floating above the sediment, and 3. a guide and support roller for the upstream portion of the conveyor band, the guide and support roller dividing the upstream conveyor band portion into an ascending part forming part of the basin and a contiguous substantially horizontal part extending from the guide and support roller towards the other roller of the first pair, the floating sludge flowing along the ascending and horizontal parts of the upstream conveyor band portion towards the other roller of the first pair, e. a housing for the conveyor band, the housing including 1. side walls closely adjacent the lateral edge of the plane conveyor band,
2. a hopper below the conveyor band,
3. a passageway adjacent the other roller of the first pair to permit overflowing sludge to pass into the hopper by gravity, and
4. a vertical support for the lower and upper rollers, and f. a discharge chute for the solid granular material arranged underneath the one roller of the first pair to receive the solid granular material by gravity.

2. The apparatus of claim 1, further comprising a lining of resilient material on the side walls of the housing in the range of the upper course of the conveyor band.

3. The apparatus of claim 1, further comprising upwardly directed nozzles in the basin arranged to move the sludge towards the guide and support roller.

* * * * *